US005765458A

United States Patent [19]

Nakagawa et al.

[11] Patent Number: 5,765,458

[45] Date of Patent: Jun. 16, 1998

[54] DIE FOLLOW CONFIRMING METHOD

[75] Inventors: Hiroshi Nakagawa; Michiharu Ichikawa; Yoshitami Matsui, all of Aichi, Japan

[73] Assignee: Nisshinso Industries, Inc., Japan

[21] Appl. No.: 601,868

[22] Filed: Feb. 15, 1996

[30] Foreign Application Priority Data

Feb. 20, 1995 [JP] Japan ..... 7-053699
Dec. 12, 1995 [JP] Japan ..... 7-346123

[51] Int. Cl.[6] ..... B26D 7/24

[52] U.S. Cl. ..... 83/13; 83/72; 83/62.1; 83/527.12

[58] Field of Search ..... 83/13, 34, 35, 83/36, 50, 55, 58, 62, 62.1, 72, 549, 552, 571, DIG. 1, 522.12

[56] References Cited

U.S. PATENT DOCUMENTS

| | | | |
|---|---|---|---|
| 3,733,944 | 5/1973 | Dietrick et al. | 83/62 X |
| 3,747,142 | 7/1973 | Arbogast et al. | 83/62 X |
| 3,874,205 | 4/1975 | Roch et al. | 72/8 |
| 3,979,980 | 9/1976 | Biester et al. | 83/62 X |
| 4,091,698 | 5/1978 | Obear et al. | 83/530 X |
| 4,205,567 | 6/1980 | Hirata et al. | 83/62.1 X |
| 4,343,210 | 8/1982 | Kuroyone | 83/552 X |
| 4,466,317 | 8/1984 | Ikeda | 83/55 X |
| 4,479,410 | 10/1984 | Taguchi | 83/13 |
| 4,538,493 | 9/1985 | Perazzolo et al. | 83/530 |
| 4,651,601 | 3/1987 | Sasaki | 83/62.1 X |
| 4,676,090 | 6/1987 | Nishimura et al. | 83/527 X |
| 5,042,336 | 8/1991 | Capps | 83/13 X |
| 5,205,149 | 4/1993 | Hayashi | 83/552 X |
| 5,478,001 | 12/1995 | Pillsbury et al. | 83/13 X |

FOREIGN PATENT DOCUMENTS

| | | | |
|---|---|---|---|
| 0120430 | 9/1980 | Japan | 83/62 |

*Primary Examiner*—Rinaldi I. Rada
*Assistant Examiner*—Boyer Ashley
*Attorney, Agent, or Firm*—Rogers & Killeen

[57] ABSTRACT

A method of detecting whether the ram of a punch press machine follows the upper die assembly of the machine after the pressing of a work piece involving the monitoring of current flow through an electrical circuit. The electrical circuit consists of an electrical conductor, located on the side of the ram, held in the electrically conductive state. The electrical conductor and an earthing path function as a watching switch for watching the position of the ram controlled by a controlling device to determine whether the upper die assembly follows the ram or not by electrically detecting whether the ram comes in contact with the upper die assembly. A first allowable detection time and a second allowable detection time are preliminarily set in order to electrically detect that the ram comes in contact with the upper die assembly within particular thresholds. If contact of the ram with the upper die assembly is detected within the second allowable detection time in excess of the first detection time a preliminary announcement from the controlling device is issued to indicate that the upper die assembly followed the ram with a delay. If the foregoing contact is detected in excess of the second allowable detection time, a determination that the upper die assembly does not follow the ram is made and an alarm is issued from the controlling device to stop operation of the punch press machine.

10 Claims, 7 Drawing Sheets

DIE FOLLOW CONFIRMING METHOD

BACKGROUND OF THE INVENTION

The present invention relates generally to a die follow confirming method for a punch press machine. More particularly, the present invention relates to a method of confirming whether an upper die is parted away from a work or not by detecting whether or not an upper die assembly performs a return operation via following a rising ram after completion of a pressing step in order to determine a position for the work for a next pressing operation after confirming that the upper die is parted away from the work when the work is located for performing a punch pressing operation.

Conventionally, a method of disposing a photoelectric tube and a light receiving portion with an upper die interposed therebetween and a method of making determination as a state that the upper die is parted away from a work in the case that a reflected light receiving type photoelectric tube is disposed adjacent to the upper die, a ram is located at the upper dead point position within a predetermined range, and the upper die shuts the light emitted from the photoelectric tube at the upper dead point are known as means for confirming whether or not the upper die is raised until the upper die is parted away from a work after the work is subjected to punching by operating a punch press machine.

However, when the conventional method is employed, a number of reflected light receiving type photoelectric tubes, a number of normal photoelectric tubes and light receiving portions should be arranged within a limited space in order to operate the press corresponding to each thickness of the work. In practice, there is a limit that the photoelectric tubes and light receiving portions can be disposed corresponding to only two to three kinds of thickness of work.

On the other hand, owing to the facts that a punch press machine of the thrust type adapted to be operated by reciprocable movement of a hydraulic cylinder has a possibility that the hydraulic cylinder can be stopped at an arbitrary position, and there is an advantageous effect that a distance of the displacement of a ram for next thrusting is shortened and thereby high speed working becomes possible when the stopped position of rising of the upper die after completion of press working is determined in the proximity of an upper surface of the work as far as possible, there is employed a method of stopping the ram at the position corresponding to the thickness of a work. However, also in this case, there is a problem that the number of photosensitive tubes corresponding to the number of thicknesses of works should be disposed at different positions to corresponding to thicknesses of each work in order to detect confirmation of the position where rising of the upper die stopped with the aid of a photosensitive tube.

In view of the foregoing facts, if a die following confirming method adaptable not only for allowing a hydraulic cylinder to be stopped at an arbitrary position but also applicable to a punch press machine requiring no large space for disposing detecting means is developed, this is very useful. A primary object of the present invention is to provide a die follow confirming method of the foregoing type.

On the other hand, in the case of a die having a long upper die return time, when whether a return rising upper die comes in contact with a ram or not is instantaneously discriminated, there is a danger that it is determined that a malfunction of strip miss occurs in spite of the fact that the upper die follows the ram. To deal with the foregoing malfunction, a desired time is preliminarily set for judging whether the upper die follows the ram or not so that it is determined during this desired time whether the upper die follows the ram or not. Thus, since the press machine is not stopped by adequate operation of a die follow confirming device also in the case of a die requiring a considerable return time due to a tendency of local engagement of a work like a die having reduced sharpness of a heavy upper die and a punch blade, this leads to the result that productivity can be improved. Accordingly, a secondary object of the present invention is to provide a die follow confirming method suitably employable as a follow conforming method for a die having slow return as mentioned above.

SUMMARY OF THE INVENTION

The present invention has been made in consideration of the aforementioned background.

According to the present invention, there is provided a die follow confirming method employable for a punch press machine including a die holding device provided with a pair of or plural pairs of upper die assemblies and horizontally fixed lower dies disposed on a main body of the punch press machine, each of the upper die assemblies being slidably displaced in the vertical direction and constituting an electricity conducting member, a position determining device for determining a position of a work relative to a desired one set of upper die assembly and a lower die, rams each for thrusting the upper die assembly with its own lower end surface in the vertical direction for performing press working for a work, a press driving device for driving the rams in the vertical direction, a controlling device for controlling the press driving device inclusive of the position of each ram, a ram position detecting device for detecting the position of each ram as seen in the vertical direction and transmitting the position to the controlling device, an electricity conducting mechanism disposed in each ram, and earthing means for electrically earthing the upper die assemblies, wherein the method comprises the steps of allowing a work to be subjected to press working in cooperation of the upper die assembly with the lower die by lowering the ram of the punch press machine to thrust the upper die assembly, holding the electricity conducting mechanism on the ram side in the electrical conductive state when the ram is raised up, electrically detecting operations that the ram comes in contact with the upper die assembly and the ram is parted away from the upper die assembly, and allowing the electricity conducting mechanism and the earthing means to function as a watching switch for watching at the position of the ram controlled by the controlling device whether the upper die assembly follows the ram or not.

The electricity conducting mechanism on the ram side is electrically shut by disposing an electrical isolating member between an electricity conducting member and the ram and forms the electricity conducting member by supporting an electrical contact on the electricity conducting member so that electricity is fed to a terminal of the electrical contact.

The electrical contact isolated from the ram is formed by a contact piece projecting downward of the lower end surface of the ram, and when the ram thrusts the upper die assembly, the contact piece comes in contact with the upper part of the upper die assembly together with the ram, causing electricity to be fed from the contact piece to the upper die assembly via the contacting.

The position of the ram set by the controlling device varies depending on a quantity of variation of a thickness of the work.

When contact of the ram moving toward the upper dead point or the ram located at the upper dead point with the upper die assembly is detected in order to electrically detect that the ram comes in contact with the upper die assembly or the ram is parted away from the upper die assembly, a first allowable detection time and a second allowable detection time are preliminarily set, and when contact of the ram with the upper die assembly is detected within the allowable detection time in excess of the first allowable detection time, this is determined such that the upper die assembly follows the ram with delay so that preliminary announcement is issued from the controlling device.

The second allowable detection time is set as a time for alarming and machine stoppage, and when contact of the returning upper die assembly with ram is not detected in excess of the second allowable detection time, this is determined such that the upper die assembly does not follow the ram so that alarm is issued from the controlling device to stop operation of the punch press machine.

Other objects, features and advantages of the present invention will become apparent from reading of the following description which has been made in conjunction with the accompanying drawings.

DESCRIPTION OF THE PREFERRED EMBODIMENT

The present invention will now be described hereinafter with reference to the accompanying drawing which illustrate a preferred embodiment thereof.

Figure 1:
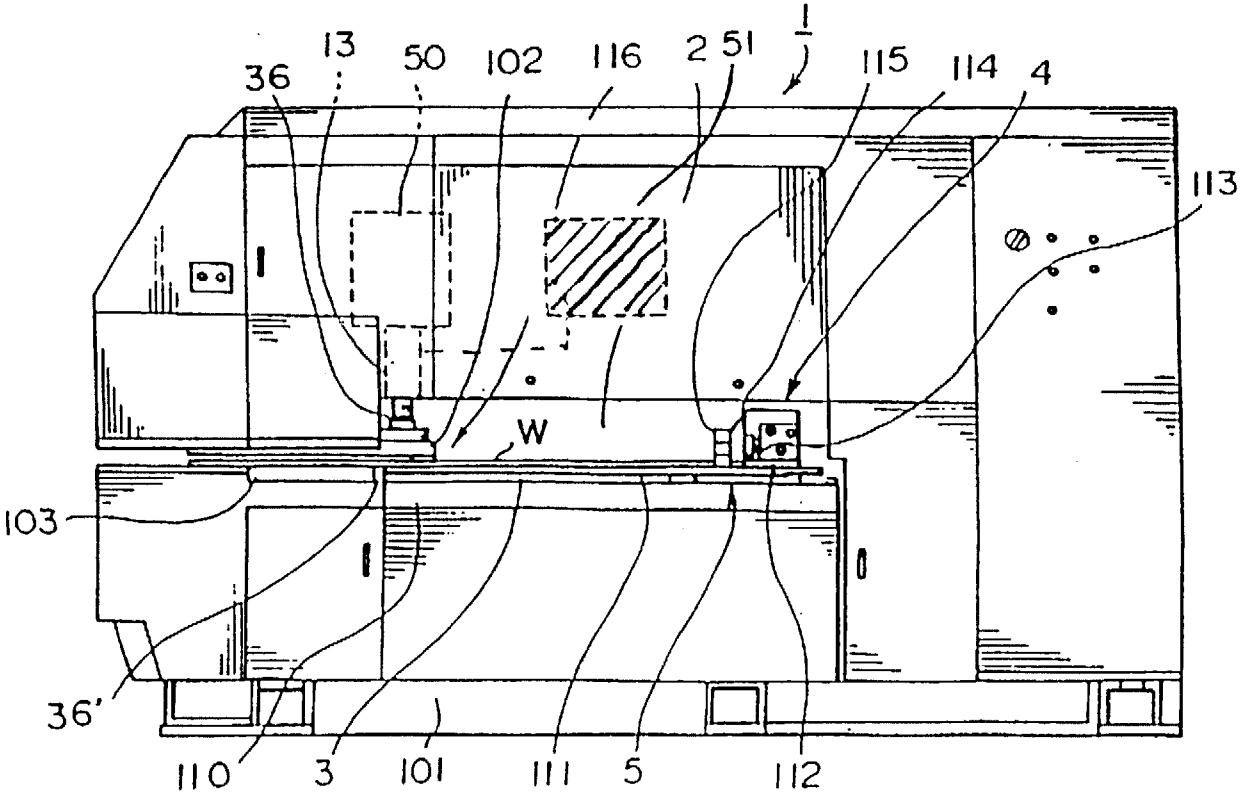
FIG. 1 is a side view of a turret punch press to which a first detecting method of the present invention is applied.

FIG. 1 is a side view of a turret punch press machine 1 for which a die follow confirming method for the punch press machine of the present invention is practiced. The turret punch press machine 1 having a frame 101 including a deep working space 2 as a press main body includes a turret device 116 comprising a table 3 for holding a plate-shaped work W, a X-coordinate locating device 4 and a Y-coordinate locating device 5 each serving to locate the work W, a rotary circular disc-like upper turret 102 having an upper die assembly 36, and a rotary lower turret 103 having a lower die 36'.

A ram 13 trusting the upper die assembly 36 of the upper turret 102 from the upper surface side is vertically slidably supported at the upper part of the frame 101, and a press driving device 50 for vertically driving the ram 13 is provided.

The table 3 is located below the deep working space 2 and provided on a slide frame 110 arranged on the frame 101. The Y-coordinate locating device 5 for the table 3 includes a Y-coordinate carriage 112 supported via a rail 111 mounted on the slide rail 110 to be displaced in the longitudinal direction of the frame 101, a X-coordinate carriage 114 supported via the rail for the Y-coordinate carriage 112 to be displaced in the transverse direction. The X-coordinate locating device 4 supported via a support rail 113 to be displaced in the transverse direction is mounted on the Y-coordinate carriage 112. A clamp 115 serves to hold the work W in the clamped state. With this construction, the work W can arbitrarily be located relative to the turret device 116 not only in the transverse direction but also in the longitudinal direction (X-coordinate and Y-coordinate).

Figure 2:
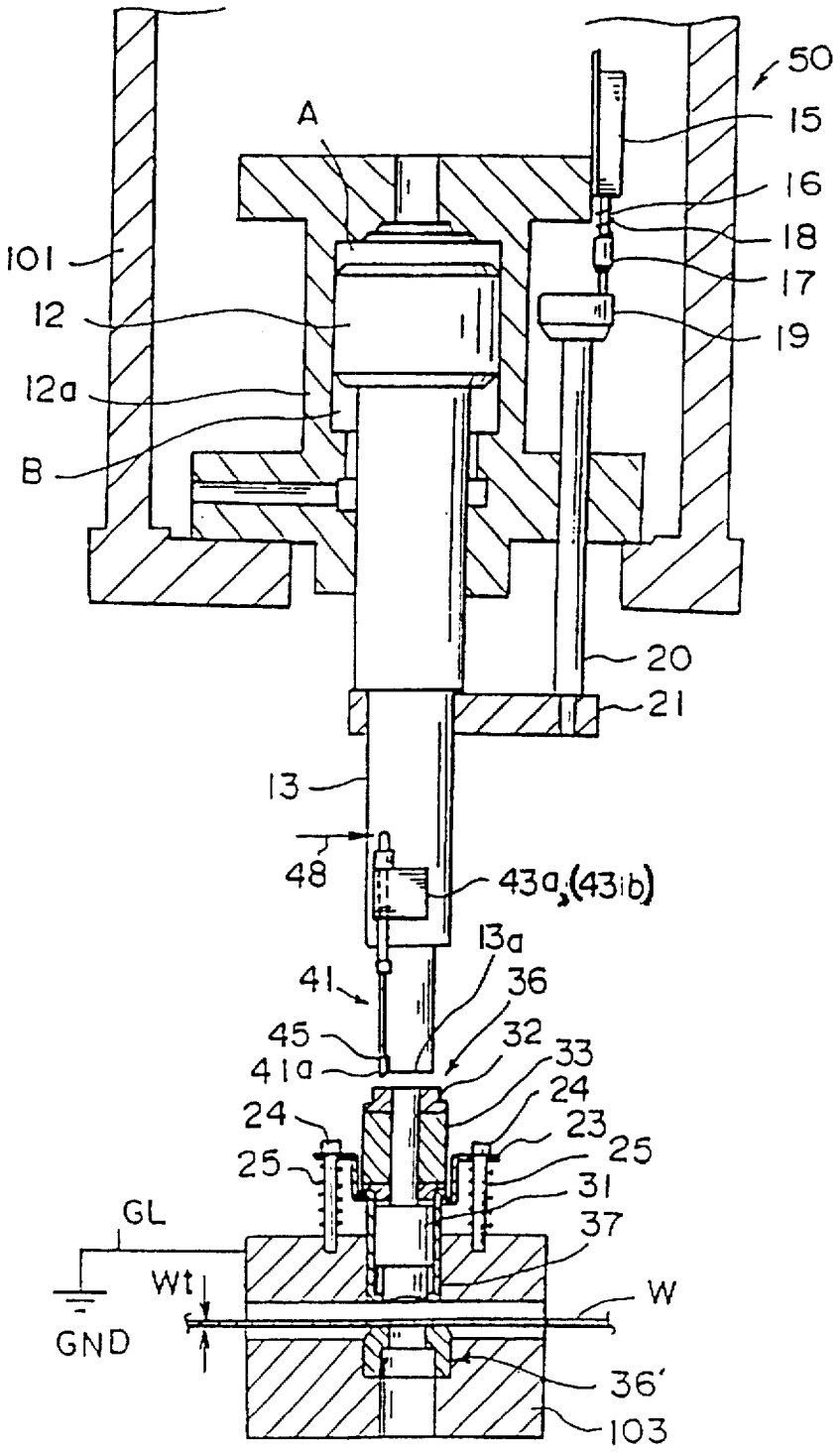
FIG. 2 is a fragmentary sectional view which shows essential components of the turret punch press shown in FIG. 1 to which the method of the present invention is applied.

FIG. 2 is a sectional view which shows the state that a press driving device 50 of the punch press machine 1 starts a punching operation, and the work W is located between the upper die assembly 36 and a lower die 36' by the foregoing locating devices 4 and 5. The press driving device 50 is composed of a hydraulic cylinder **12*a*, a piston 12 arranged in the cylinder 12*a* and a ram 13 connected to the piston 12 to be displaced in the vertical direction, and it is mounted on the main frame 101 of the press machine 1 to thrust the upper die assembly 36** directly from the above in the vertical direction.

Reference numeral 15 denotes a ram position detecting device for detecting a stroke position of the ram 13. In this embodiment, a potentiometer is used for the ram position detecting device 15. The ram position detecting device 15 is fixed to the hydraulic cylinder **12*a* such that the sliding direction of the piston having the ram 13 connected thereto coincides with the sliding direction of the detecting rod 16 inserted into the detecting device 15 and displaced to freely move through the detecting device 15. Reference numeral 17 denotes a sensor head fitted to the foremost end of the detecting rod 16 which is biased by a spring 18 and comes in engagement with a dog 19. Reference numeral 20 denotes a guide rod which serves to prevent the ram 13 from being rotated with the aid of the hydraulic cylinder 12*a* and transmits the vertical movement of the ram 13 to the dog 19. Reference numeral 21 denotes a connecting rod by way of which the ram 13 is connected to the guide rod 20 and which is firmly fixed to the ram 13**.

Reference numeral 102 denotes an upper turret which includes a pair or plural pairs of upper die assemblies 36, is rotatably supported by a bearing device (not shown) disposed on the main body frame 101 and is earthed via an earthing line GL. Each upper die assembly 36 includes a cutting blade for punching operation at the lower end and is composed of a punch 31 inserted into the die hole of the upper turret 102, a pair of guide posts 24 standing upright on the upper turret 102, a pair of springs 25 fitted around the guide posts 24, and a tool lifter 23 so that the upper die assembly 36 is raised up by the tool lifter 23 having the resilient force of the springs 25 received thereby and the upper limit of the upper die assembly is restricted by upper end limiters of the guide posts 24.

Reference numeral 103 denotes a lower turret which includes a die 27 forming a pair of lower die 36' in cooperation with the punch 31 in the upper die assembly 36 and which is rotatably supported by a bearing device (not shown) mounted on the main body frame 101. Reference character W denotes a work which is to be subjected to punching operation while it is located between the punch 31 and the die 27 of the upper die assembly 36 with the aid of the X-coordinate position determining device 4 and the Y-coordinate position determining device 5.

Reference numeral 41 denotes a contact piece formed of an elective conductive material to serve as a contact piece. The contact piece 41 is vertically slidably supported by upper guide blocks 43*a* and 43*b* and a lower guide block 45 and attached to the ram 13 so that it is vertically displaced together with the ram 13. While the upper surface of the upper die assembly 36 does not contact with the contact piece 41, the lower surface 41*a* is projected slightly from the lower end surface 13*a* of the ram 13.

Figure 3:
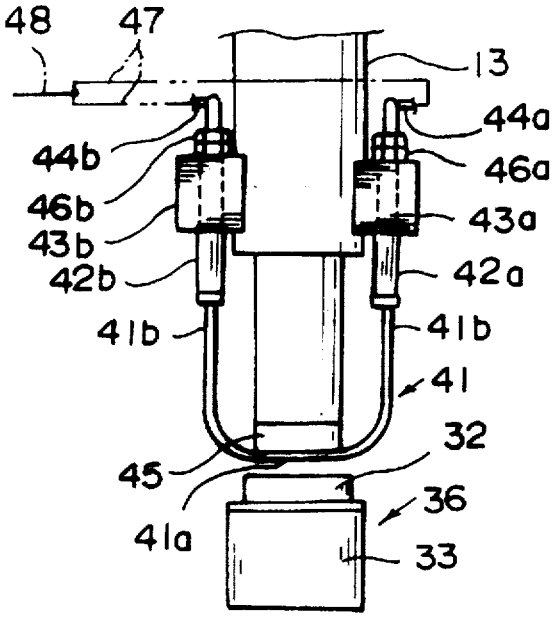
FIG. 3 is a side view which shows by way of example essential components constituting an electricity conducting mechanism to be used for the method of the present invention.
Figure 4:
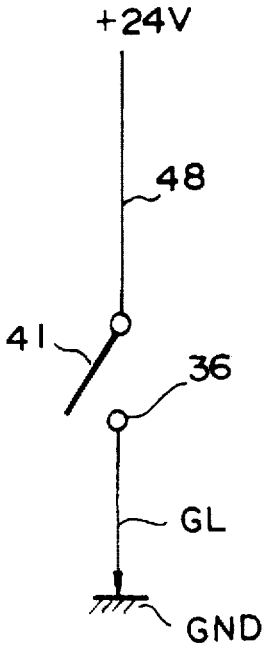
FIG. 4 is a schematic view of an electric circuit of the electricity conducting mechanism shown in FIG. 3.

Detail of the contact piece 41 attached to the ram 13 will be described with reference to FIG. 3 and FIG. 4. The contact piece 41 is formed in the substantially U-shaped contour and upper ends of the U-shaped part are formed as connecting terminals 44*a* and 44*b*, while the lower surface 41*a* of the U-shaped parts serves as a portion which comes in contact with a head 32 made of an electrically conductive material and disposed on the upper surface of the upper die assembly 36. Incidentally, either one of the connection terminals 44*a* and 44*b* is sufficient for the electrical purpose. Upper guide blocks 43*a* and 43*b* are made of an electrically insulative material, e.g., bakelite and attached to the ram 13. Two vertical linear portions 41*b* of the U-shaped part of the contact piece 41 are slidably supported in the vertical direction while resiliently urging in the downward direction by the upper guide blocks 43*a* and 43*b* via springs 42*a* and 42*b*, and the position of the lower surface 41*a* of the contact piece 41 is adjustably restricted by adjusting nuts 46*a* and 46*b*. A lower guide block 45 is formed of an electrically insulative material, e.g., bakelite and serves to prevent from making contact between the ram 13 and contact piece 41. When direct current of 24 V is applied to a main cable 48 while the foregoing state is maintained, since no contact is made between the upper die assembly 36 and the contact piece 41, no electric current flows to the earthing line GL side of the upper turret 102. In FIG. 3, reference numeral 47 designates a lead line and FIG. 4 is a schematic view which shows the foregoing state as an electric circuit diagram.

Figure 5:
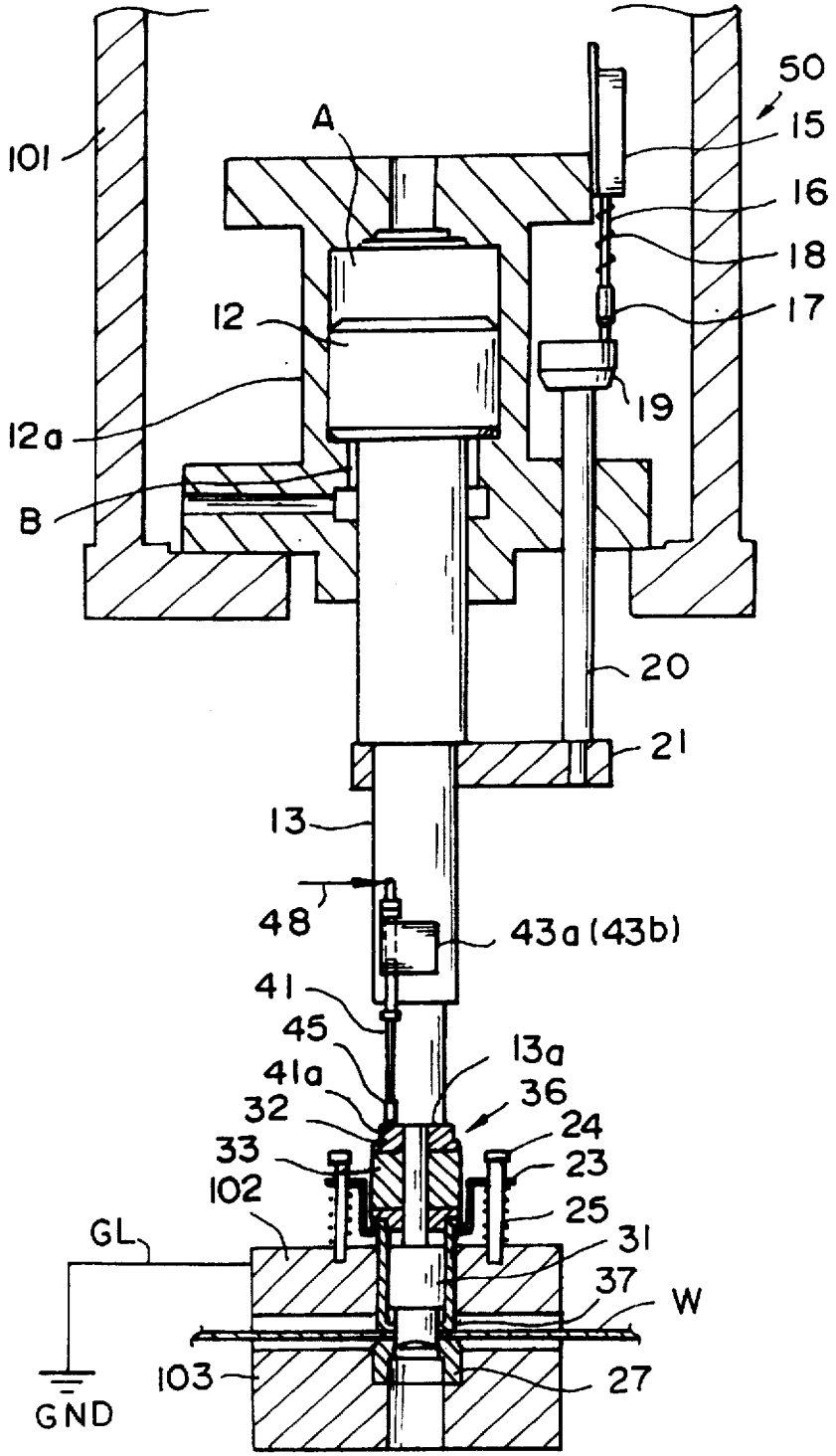
FIG. 5 is a fragmentary side view which shows essential components when a punching operation is performed with the punch press machine shown in FIG. 2.

FIG. 5 is a sectional view which shows the state that the ram 13 is lowered to the lower end of a punching operation, i.e., the position of a lower dead point, and the ram controls a hydraulic valve (not shown), and by feeding the hydraulic working oil into an upper chamber A, the contact piece 41 is lowered together with the ram 13 and the ram 13 thrusts the upper surface of the upper die assembly 36 at the lower end surface 13*a* of the ram 13. At the time of thrusting, the contact piece 41 is thrusted in the upward direction against the resilient force of the springs 42*a* and 42*b* until the lower surface 41*a* of the contact piece 41 is flush with the lower surface 13*a* of the ram 13, and moreover, the upper die assembly 36 is lowered together with the tool lifter 23 against the resilient force of the springs 25, causing the lower surface of a stripper 37 made of an electrically conductive material while constituting the upper die assembly 36 to come in contact with the work W. Subsequently, when the thrusting force of the ram 13 is applied, the stripper springs 33 are compression-deflected on receipt of the ram 13. Thus, the punch 31 made of an electrically conductive material is further lowered so that the cutting blade portion of the punch 31 enters the cutting blade of the die 27 to thereby perform a pressing operation for the work W.

The lowered position of the ram 13 at this time is detected by the detecting device and is fed back to a controlling device 51 for controlling the press driving device so that the controlling device controls the lower dead position of the ram 13 by controlling the controlling valve. On the other hand, when the lower surface 41*a* of the contact piece 41 comes in contact with the electric conductive head 32 disposed on the upper surface of the upper die assembly 36, electricity from the main electric line 48 flows via the contact piece 41, the head, the punch, the stripper 37, the upper turret 102 and the earthing line GL until it is earthed.

Figure 6:
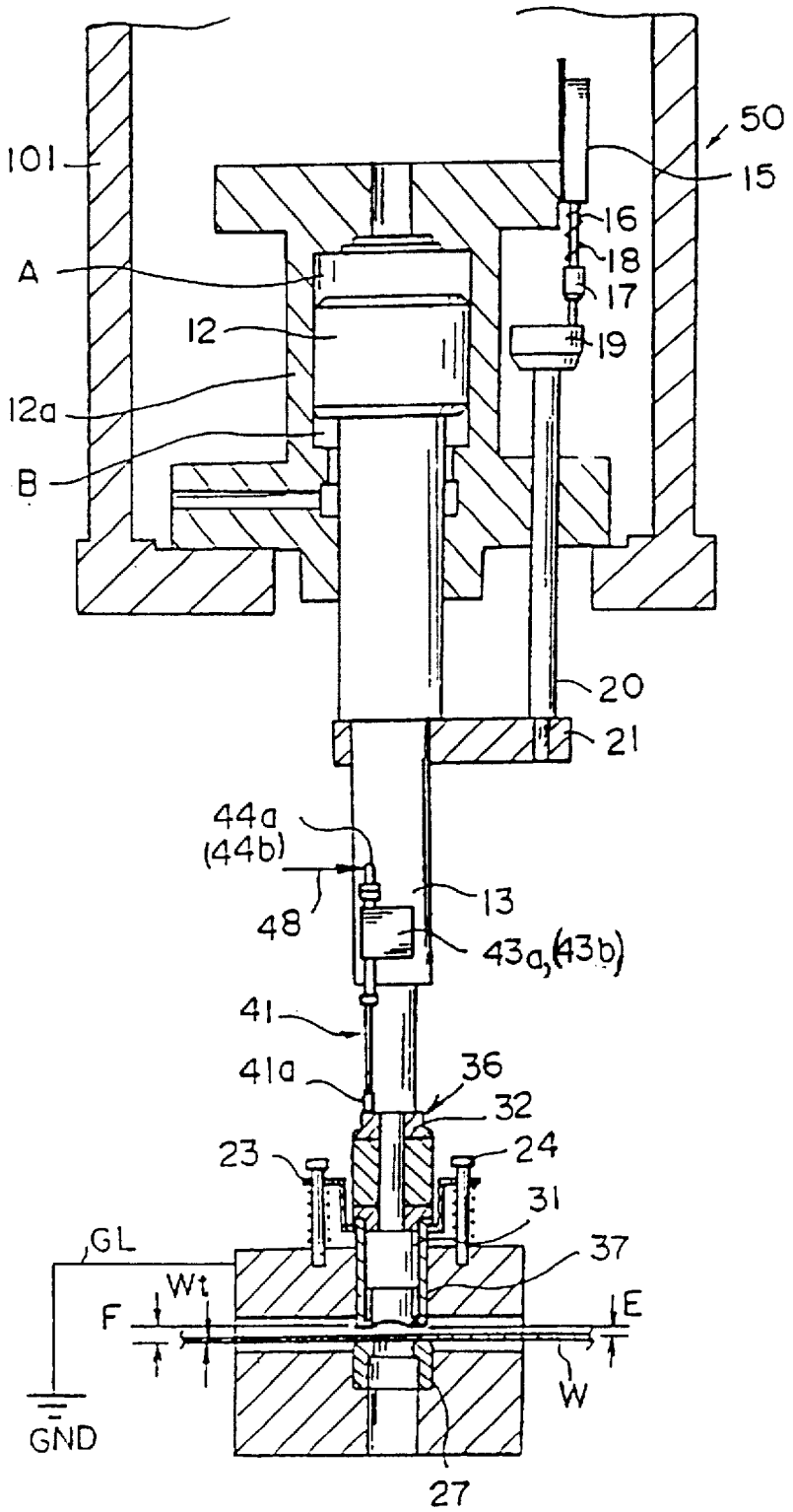
FIG. 6 is a fragmentary side view which shows the state that an upper die assembly follows a ram after completion of the punching operation as shown in FIG. 5.
Figure 7:
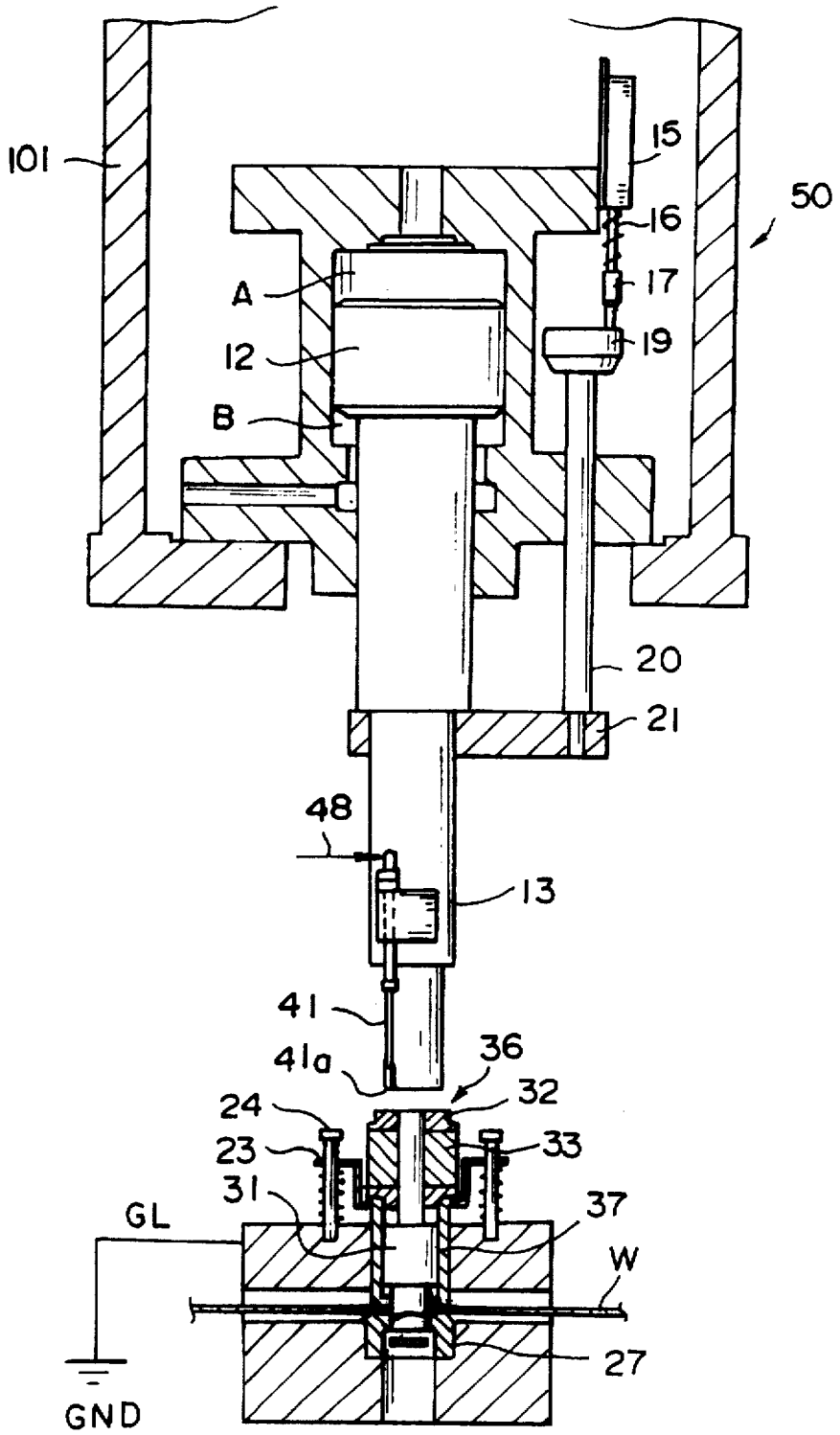
FIG. 7 is a fragmentary side view which shows the state that the upper die assembly does not follow the ram after completion of the punching operation as shown in FIG. 5.

FIG. 6 is a sectional view which shows that the ram 13 is raised from the lower dead point shown in FIG. 5, and it is determined at this position of the ram 13 whether the head 32 of the upper die assembly 36 comes in contact with the contact piece 41 or not. According to the present invention, if electricity flows to the ground GND via the earthing line GL when the ram 13 assumes this position, the upper die assembly 36 is followably raised to the ram 13 at the foregoing position. On the contrary, when electricity does not flow to the ground GND, it is determined that the upper die assembly 36 does not follow the rise (return) of the ram 13 (see FIG. 7).

In other words, according to a first detecting method of the present invention, when the ram 13 is located at the raised position set corresponding to the sheet thickness Wt of the work W, an electricity conducting mechanism including the contact piece 41 on the ram side as a main component and earthing means on the upper turret 102 side functions as a switch for detecting whether the upper die assembly 36 is followably raised relative to the rising ram 13 or not, depending on whether or not at the position of the ram 13 electricity flows from the terminals 44*a* and 44*b* to the ground GND via the earthing line GL. In addition, according to the first detecting method, the state that the upper die assembly 36 can not follow the ram 13 is determined as strip miss.

FIG. 6 is a sectional view which shows the operative state that when the ram 13 reaches the working lower dead point, the controlling device for controlling the press driving device controls the control valve, working hydraulic oil is fed to a lower chamber B of the cylinder 12*a* to raise the ram 13, and the ram 13 is stopped at the position set corresponding to a sheet thickness Wt of the work W. It is not necessary that the stopped position of the ram 13 at this time is returned to the initial state as shown in FIG. 2, and it is sufficient that a vertical space E necessary for allowing the work W to be located at a next working position is present between the upper surface of the die 27 and the lower surface of the stripper 37. Accordingly, if the controller is controlled such that next position determining is started for the X-coordinate position determining device 4 and the Y-coordinate position determining device 5 at this time point, the time required for press working can be reduced. In other words, the aforementioned vertical space E has a meaning as a space for detecting the presence or absence of strip miss.

According to the first detecting method, an optimum stopped position of the ram 13 is preferable when a dimension of subtracting the sheet thickness Wt from the vertical space F defined by the upper surface of the die 27 and the lower surface of the stripper 37, i.e., a distance from the upper surface of the work W to the stripper 37 is small, and moreover, the space E does not vary even though the sheet thickness Wt of the work W varies. To this end, it is sufficient that the stopped position is set with the sheet thickness Wt of the work W as a variable and it is controlled.

On the other hand, in such a controlling manner that the distance from the upper surface of the work W in FIG. 6 to the stripper 37 is set as a strip miss detecting section E so as to detect whether the die assembly 36 follows the ram 13 or not like in the aforementioned embodiment, the upper die assembly 36 does not follow the ram 13 unless the upper die assembly 36 does not contact with the ram 13 within the following confirming section E, that is, the controller determines this state as strip miss and generates an alarm, causing the press machine to temporally stop.

In this controlling manner, however, with respect to the large-sized heavy upper die assembly 36 or the upper die assembly 36 of which return operation has a tendency of delaying due to local engagement with the work due to degraded sharpness of the punch blade, even though no strip miss is caused in practice, the upper die assembly 36 does not follow the ram 13. In other words, since it is determined that there occurs strip miss and an alarm is activated, causing the press machine to readily stop, a problem is that the result is that productivity is deteriorated.

A second detecting method of present invention is practiced in view of the foregoing circumstances. According to the first detecting method, even though the press machine is held in the state that it is judged that the upper die assembly 36 doe not follow with the section E, this is not immediately judged as strip miss, an arbitrary time is set which is allowed so as to cause the upper die assembly 36 to be raised up while the ram 13 returns to the upper dead point in the section E, and when it is detected that the ram 13 moving toward the upper dead point as the upper die assembly 36 is raised up within the foregoing set time or the ram 13 located at the upper dead point is detected, it is determined that the upper die assembly 36 follows the ram 13, whereby it is possible that useless alarming and machine stopping are not caused during a press operation having the die assembly having a slow return used therefor. Thus, this point of fact will be described with reference to FIG. 8.

The embodiment of the first detecting method described with reference to FIG. 2 to FIG. 7 is such that the confirming portion of the ram 13 for the upper die assembly 36 is formed as shown in an enlarged size in FIG. 3, and when the upper die assembly 36 does not contact with the contact piece 41 disposed at the lower end of the ram 13 at the terminal end of the strip miss detecting section E in association with the first method, it is determined that strip miss is caused.

The second method of the present invention is such that even when it can not be determined that following of the upper die assembly 36 to the ram 13 can not be confirmed in the strip miss detecting section E according to the first method, a required waiting time that can allow the upper die assembly 36 to be raised up across the section E is preliminarily set, and if following of the upper die assembly 36 to the ram 13, i.e., contact of the upper die assembly 36 with the ram 13 can be confirmed, no alarming operation and no machine stoppage are caused. This point of fact will be described with a flowchart of FIG. 8.

Figure 8:
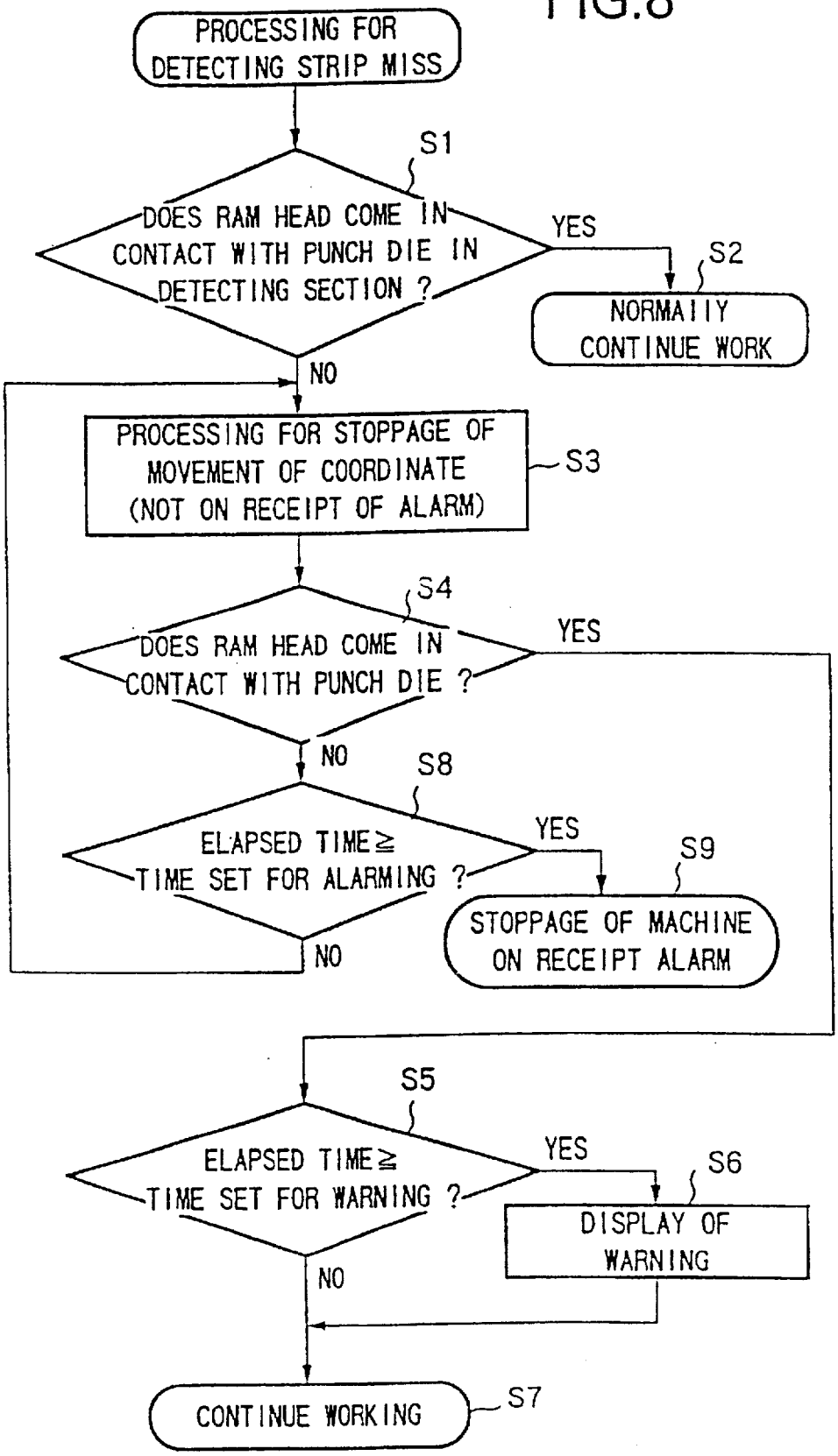
FIG. 8 is a flowchart which shows a second detecting method of the present invention.

In FIG. 8, detecting of the strip miss (following of the upper die assembly 36 to the ram 13), i.e., contacting of the upper die assembly 36 with the ram head 13 at the detecting section E is detected at first step S1 and if the contacting is detected, it is determined at Step S2 that the contacting is normal, and then press working continues (the first method of the present invention). However, according to the second embodiment, when it is detected at the step S1 that the upper assembly 36 does not contact with the ram head 13 at the detecting section E, moving of the work is reserved at step S3. Subsequently, it is once more judged at Step S4 whether the upper die assembly 36 comes in contact with the ram head 13 or not.

When it is confirmed at Step S4 that the ram head 13 comes in contact with the upper die assembly 36, it is judged at Step S5 that the time that elapsed till the confirmation is within the time preset for preliminary announcement or not. If the return time of the upper die assembly 36 in the detection section E exceeds the preset time for issuing preliminary announcement for stating that the present time is close to the state although it does not reach the time corresponding to alarm time and machine stop, it is set in Step S6 that the foregoing preliminary announcement is displayed, and when contact of the ram head 13 with the upper die assembly 36 is achieved within the time set for the preliminary announcement, press working continues at it is (step S7).

On the other hand, when it is judged at Step S4 that contact of the ram head 13 with the die assembly 36 is not confirmed, it is judged at Step S8 that the time that elapses till the foregoing judgement exceeds the time for alarming or not. When it does exceed it, alarming is displayed at Step S9, and the press machine stops its operation.

When it is determined at Step S8 that the foregoing elapse time is within the time set for alarming, the program return to Step S4 at which it is judged that the ram head 13 comes in contact with the upper die assembly 36 again or not. When the contact is confirmed, the program goes to Step S5. In the case that the contact can not be confirmed, it is judged again at Step S8 whether the time that elapses till that time is within the alarming time or not.

As described above, according to the second method of the present invention, it is not only confirmed within the preset detection section whether or not the upper die assembly 36 follows the ram head 13 but also in the case that the upper die assembly 36 does not come in contact with the ram head 13 within the set detecting section E, the alarm is immediately not activated and the press machine is not stopped, and when the return of the upper die assembly is confirmed within the preset time, the press working is caused to continue. Thus, erroneous detection of the strip miss is not effected and deterioration of workability can be prevented during press working with the use of a heavy die or a die having a tendency of delaying due to local engagement with the die.

The present invention has been described above, and the following specific advantageous effects are obtainable from the first invention.

(1) Since it can be confirmed at an arbitrary ram position with a single device whether or not the upper ram is raised up while following the ram, followable confirmation of the die can be confirmed for any thickness of the work with a small space. Further, since next position determination can be made with slight quantity of rising of the ram from the position where the work is parted away from the die, it is possible to effect high speed working with reduced loss time.

(2) In addition, also in the case that a work is subjected to drawing with the die, following of the die can be confirmed by controllably changing merely the step of drawing with respect to the ram stop position for the purpose of watching.

(3) Since a large magnitude of pressing force is not imparted on the contact piece and the insulator of the electricity conducting mechanism, the present invention can be applied to press working requiring a large pressing ability.

Further, the following specific advantageous effects are obtainable from the second invention.

(1) When it is detected whether the upper die assembly follows the ram or not, erroneous detecting of strip miss can reliably be prevented for the working with the use of a large sized-die having slow return, and moreover, reduction of productivity due to the erroneous detection can be prevented.

(2) With respect to a tendency of local engagement of the upper die with the work due to degrading of sharpness of the punch blade or delay of return of the upper die caused because of improper clearance between the punch and the die, since a waiting time for representing preliminary announcement of the foregoing malfunction is set, a measure of preventing strip miss such as die inspection, and correction of the die or the like after completion of the working can be taken before an occurrence of the strip miss. This leads to the result that an occurrence of strip miss attributable to the die having delay of return can reliably be prevented by displaying the foregoing preliminary announcement.

While the present invention has been described above only with preferred embodiments thereof, it should of course be understood that the present invention should not be limited to these embodiments but various change or modification may be made without departure from the scope of the present invention as defined by the appended claims.

What is claimed is:

1. A die follow confirming method employable for a punch press machine including a die holding device provided at least one pair of upper die assemblies and horizontally fixed lower dies disposed on a main body of said punch press machine, each of said upper die assemblies being slidably displaced in a vertical direction and constituting an electricity conducting member, a position determining device for determining a position of work relative to a desired one set of upper die assembly and a lower die, rams each for thrusting said upper die assembly with its own lower end surface in the vertical direction for performing press working for a work, a press driving device for driving said rams in the vertical direction, a controlling device for controlling said press driving device inclusive of the position of each ram, a ram position detecting device for continuously detecting the position of each ram as seen in the vertical direction and transmitting the position to said controlling device, an electricity conducting mechanism disposed in each ram, and earthing means for electrically earthing said upper die assemblies, comprising the steps of:

allowing a work to be subjected to press working in cooperation of said upper die assembly with said lower die by lowering said ram of said punch press machine to thrust said upper die assembly, holding said electricity conducting mechanism on a ram side in the electrical conductive state when said ram is raised up, electrically detecting operations that said ram comes in contact with said upper die assembly and said ram is parted away from said upper die assembly, and allowing said electricity conducting mechanism and said earthing means to function as a watching switch for watching at the position of said ram controlled by said controlling device whether said upper die assembly follows said ram or not, wherein when contact between the upper die assembly and either the ram moving toward an upper dead point or the ram located at the upper dead point is detected, in order to electrically detect that the ram comes in contact with the upper die assembly or the ram is parted away from the upper die assembly, a first allowable detection time and a second allowable detection time are preliminarily set, and when contact of the ram with the upper die assembly is detected within the second allowable detection time in excess of the first detection time, this is determined such that the upper die assembly follows the ram with delay so that preliminary announcement is issued from the controlling device.

2. The die follow confirming method as claimed in claim 1, wherein said electricity conducting mechanism on the ram side is electrically shut by disposing an electrical isolating member between an electricity conducting member and said ram and forms said electricity conducting member by supporting an electrical contact on said electrical insulating member so that electricity is fed to a terminal of said electrical contact.

3. The die follow confirming method as claimed in claim 2, wherein said electrical contact isolated from said ram is formed by a contact piece projecting downward of the lower end surface of said ram, and when said ram thrust said upper die assembly, said contact piece comes in contact with an upper part of said upper die assembly together with said ram, causing electricity to be fed from said contact piece to said upper die assembly via said contacting.

4. The die follow confirming method as claimed in claim 1, wherein the position of the ram set by said controlling device varies depending on a quantity of variation of a thickness of the work.

5. The die follow confirming method as claimed in claim 1, wherein the second allowable detection time is set as a time for alarming and machine stoppage, and when contact of the returning upper die assembly with the ram is not detected in excess of the second allowable detection time, this is determined such that the upper die assembly does not follow the ram so that alarm is issued from the controlling device to stop operation of the punch press machine.

6. A die follow confirming method employable for a punch press machine including a die holding device provided with a pair of or plural pair of upper die assemblies and horizontally fixed lower dies disposed on a main body of said punch press machine, each of said upper die assemblies being slidably displaced in the vertical direction and constituting an electricity conducting member, a position determining device for determining a position of work relative to a desired one set of upper die assembly and a lower die, rams each for thrusting said upper die assembly with its own lower end surface in the vertical direction for performing press working for a work, a press driving device for driving said rams in the vertical direction, a controlling device for controlling said press driving device inclusive of the position of each ram, a ram position detecting device for detecting the position of each ram as seen in the vertical direction and transmitting the position to said controlling device, an electricity conducting mechanism disposed in each ram, and earthing means for electrically earthing said upper die assemblies, comprising the steps of:

allowing a work to be subjected to press working in cooperation of said upper die assembly with said lower die by lowering said ram of said punch press machine to thrust said upper die assembly, holding said electricity conducting mechanism on a ram side in an electrical conductive state when said ram is raised up, electrically detecting operations that said ram comes in contact with said upper die assembly and said ram is parted away from said upper die assembly, allowing said electricity conducting mechanism and said earthing means to function as a watching switch for watching at the position of said ram controlled by said controlling device whether said upper die assembly follows said ram or not, preliminarily setting a first allowable detection time and a second allowable detection time in order to electrically detect that the ram comes in contact with the upper die assembly within particular thresholds, and issuing a preliminary announcement from the controlling device when contact of the ram with the upper die assembly is detected within the second allowable detection time in excess of the first detection time to indicate that the upper die assembly followed the ram with delay.

7. The die follow confirming method as claimed in claim 6, wherein said electricity conducting mechanism on the ram side is electrically shut by disposing an electrical isolating member between an electricity conducting member and said ram and forms said electricity conducting member by supporting an electrical contact on said electrical insulating member so that electricity is fed to a terminal of said electrical contact.

8. The die follow confirming method as claimed in claim 7, wherein said electrical contact isolated from said ram is formed by a contact piece projecting downward of the lower end surface of said ram, and when said ram thrust said upper die assembly, said contact piece comes in contact with an upper part of said upper die assembly together with said ram, causing electricity to be fed from said contact piece to said upper die assembly via said contacting.

9. The die follow confirming method as claimed in claim 6, wherein the position of the ram set by said controlling device varies depending on a quantity of variation of a thickness in the work.

10. The die follow confirming method as claimed in claim 6, wherein the second allowable detection time is set as a time for alarming and machine stoppage, and when contact of the returning upper die assembly with the ram is not detected in excess of the second allowable detection time, this is determined such that the upper die assembly does not follow the ram so that alarm is issued from the controlling device to stop operation of the punch press machine.

* * * * *